US010322420B2

(12) United States Patent
Lin et al.

(10) Patent No.: US 10,322,420 B2
(45) Date of Patent: Jun. 18, 2019

(54) PRESSING WATERWAY SWITCH DEVICE AND SHOWER HEAD

(71) Applicant: FUJIAN XIHE SANITARY WARE TECHNOLOGY CO., LTD, Nan'An (CN)

(72) Inventors: Xiaofa Lin, Nan'An (CN); Xiaoshan Lin, Nan'An (CN); Qiqiao Liu, Nan'An (CN); Xiaoqing Deng, Nan'An (CN); Jun Xu, Nan'An (CN)

(73) Assignee: FUJIAN XIHE SANITARY WARE TECHNOLOGY CO., LTD., Nan'An (CN)

( * ) Notice: Subject to any disclaimer, the term of this patent is extended or adjusted under 35 U.S.C. 154(b) by 126 days.

(21) Appl. No.: 15/099,578

(22) Filed: Apr. 14, 2016

(65) Prior Publication Data

US 2016/0310972 A1 Oct. 27, 2016

(30) Foreign Application Priority Data

Apr. 21, 2015 (CN) ..... 2015 1 0190219

(51) Int. Cl.
*B05B 1/16* (2006.01)
*B05B 1/18* (2006.01)

(52) U.S. Cl.
CPC ..... *B05B 1/18* (2013.01); *B05B 1/1636* (2013.01)

(58) Field of Classification Search
CPC ... B05B 1/1627; B05B 1/1636; B05B 1/1645; B05B 1/1654; B05B 1/18; B05B 1/185; B05B 1/169
USPC ..... 239/443–449, 553–553.5, 556–564, 567
See application file for complete search history.

(56) References Cited

U.S. PATENT DOCUMENTS

2012/0012676 A1* 1/2012 Hu ..... B05B 1/1663 239/525
2012/0305116 A1* 12/2012 Zhou ..... B05B 1/1636 137/625.46
2012/0312403 A1* 12/2012 Zhou ..... B05B 1/1609 137/861
2012/0312902 A1* 12/2012 Zhou ..... B05B 1/1636 239/569
2017/0136473 A1* 5/2017 Yu ..... B05B 1/1636

FOREIGN PATENT DOCUMENTS

CN 202823671 U * 3/2013
CN 201220468852.X 3/2013
CN 20140390199.3 12/2014

* cited by examiner

*Primary Examiner* — Chee-Chong Lee
*Assistant Examiner* — Cody J Lieuwen
(74) *Attorney, Agent, or Firm* — Rabin & Berdo, P.C.

(57) ABSTRACT

A pressing waterway switch device and shower includes a fixed housing and a pressing switch mechanism, the pressing switch mechanism includes a button, a switching component, and a transmission component, the button, the driving piece and the switching component are all or part of connected with an elastic piece. The pressing waterway switch device is installed in a shower body with the button disposed outside. By pressing the button makes the water outlet function changed in switch manner, and the water outlet function includes shower spray function, massage spray function and shower spray combined with massage spray together.

17 Claims, 7 Drawing Sheets

PRESSING WATERWAY SWITCH DEVICE AND SHOWER HEAD

FIELD OF THE INVENTION

The present invention relates to the field of pressing switching water outlet, especially to a pressing waterway switch device and shower.

BACKGROUND OF THE INVENTION

The existing shower in the market normally can perform varieties of water outlet function by selection, such as shower spray, massage spray, combining massage spray and massage spray together and so on, most of them accomplish outlet switching function by rotating the shower panel, or installing button switching mechanism, rotating switching mechanism or swing switching mechanism to accomplish outlet switching function. Among these, button switching is prevalently favored by the users cause its easy and straightforward operation. Presently, one of the button switching structure to switch shower function is designed to a button cooperated with two groups of ratchets in transmission way, and both two groups of ratchets are coupled in the water cavity of the body, however, several disadvantages of the above switching structure are as following: much more components cooperating with each other will enlarge structural error resulted in unstable working status; both of two groups of ratchets are invisible, and that will lead to not convenient to control, maintenance, disassembly and assembly.

SUMMARY OF THE INVENTION

The present invention is provided with a pressing waterway switch device and shower, to overcome the disadvantages of existing pressing switching structure in prior art.

One technical solution to the above technical problems for the present invention is:

a pressing waterway switch device, comprising a fixed housing and a pressing switch mechanism, the fixed housing being capable of making water outlet in at least two functions or two modes, the pressing switch mechanism comprises:

a button;

a switching component in rotary connection with the fixed housing comprising a water diversion plate arranged in the fixed housing and a rotating shaft which is coaxially connected with the water diversion plate and stretches out of the fixed housing from a through hole in a sealing manner, the water diversion plate rotating with respect to the fixed housing for accomplishing certain water outlet function or switching water outlet mode;

a transmission component being in transmission activation with the button and being connected to the rotating shaft while fixed out of the fixed housing, and a first transmission structure being arranged between the transmission component and the outer wall of the fixed housing, when the is button pressed, the transmission component and the switching component performing axial motion and rotate in preset angle under the impact of the first transmission structure; all or part of the button, the driving piece and the switching component being all or part of connected with an elastic piece which is used for storing energy when the button is pressed.

a second transmission structure is correspondingly arranged between the water diversion plate of the switching component and the inner wall of the fixed housing, when the button released, said elastic piece will release its energy to urge the transmission component and the switching component to axially return to their original position and maintain rotating in preset angle under the impact of the second transmission structure.

In another preferred embodiment, said first transmission structure comprises several first ratchets which are circumferentially disposed on said transmission component at interval as well as several second ratchets disposed on the outer wall of said fixed housing at interval along circumferential direction around said through hole to mesh with the first ratchets, when said elastic piece releases its energy, the first ratchets will detach from the second ratchets with staggered position against each other.

In another preferred embodiment, said second transmission structure comprises several third ratchets which are circumferentially disposed on said water diversion plate at interval as well as several fourth ratchets disposed on the inner wall of said fixed housing at interval along circumferential direction around said through hole to mesh with the third ratchets, when said elastic piece stores its energy, the third ratchets will detach from the fourth ratchets with staggered position against each other.

In another preferred embodiment, said button is movably connected to the outer side (2-c in FIG. 6) of said fixed housing, a spring bead is installed on said fixed housing near the side of said button, when said button is pressed, the spring bead will be pushed and extruded from the side at the same time.

In another preferred embodiment, the quantity of said elastic piece is set one and said elastic piece is set to be a spring which is disposed between said water diversion plate and said fixed housing and pushes against each other. In another preferred embodiment, at least two water outlet channels and an inlet cavity with inlet hole are arranged in said fixed housing to accomplish said water outlet mode, and at least two groups of first water-through holes are circumferentially disposed on the fixed housing, each group of first water-through holes comprise more than one water-through hole, the at least two groups of first water-through holes are connected to the inlet cavity and are corresponding to and communicated with at least two water outlet channels respectively, said water diversion plate can make each group of first water-through holes be functional of water outlet simultaneously or selectively by its rotation with respect to the fixed housing.

In another preferred embodiment, said fixed housing comprises an upper cover, a lower cover and a base, the upper cover and the lower cover are fixed with each other to form said at least two water outlet channels, the lower cover is disposed with at least two groups of first water-through holes, the lower cover and the base are fixed with each other to enclose said inlet cavity; said water diversion plate is set in the inlet cavity and cooperates with the inner wall of the lower cover (i.e., the inner side 1-a of the lower cover) to form said second transmission structure, the water diversion plate can rotate with respect to the lower cover; said upper cover and lower cover are respectively provided with said through hole, said transmission component cooperates with the outer wall (2-a) of the upper cover to form said first transmission structure.

In another preferred embodiment, said water diversion plate is set in cam structure while its rotating can make each group of first water-through holes be functional of water outlet simultaneously or selectively, or, said water diversion plate is disposed with more than one dividing hole, the rotation of said water diversion plate can make the dividing holes communicate with each group of the first water-through holes in switch manner or in simultaneous way. In another preferred embodiment, also comprises a sealing cushion which is provided with at least two groups of second water-through holes corresponding to and communicating with each group of said first water-through holes, as well as comprises a center hole set for said rotating shaft passing through, said sealing cushion is installed at the inner side of said lower cover, when said button is released, said water diversion plate would be tightly attached to the sealing cushion.

In another preferred embodiment, a shaft hole is disposed at the inner bottom side of said base, the bottom end of said rotating shaft is movably connected to and inserts in the shaft hole; a sealing ring is coupled to said rotating shaft to seal the gap between said rotating shaft and said upper cover. In another preferred embodiment, said base is extending upwardly with a support bracket, one end of said button is pivotally connected to the support bracket with a pivot pin.

In another preferred embodiment, said fixed housing is set to be a shower housing with at least two water outlet function and disposed with at least two groups of water-through holes in circumferential direction, each group of water-through holes comprises more than one water-through hole, the at least two groups of water-through holes are connected to the inlet cavity of the shower housing and are corresponding to the at least two water outlet function of the shower housing respectively, said water diversion plate can make each group of water-through holes be functional of water outlet simultaneously or selectively by its rotation with respect to the shower housing.

A shower, comprises a shower body which is provided with at least two water outlet function, also comprises said pressing waterway switch device, said fixed housing is provided with at least two water outlet modes which are corresponding to each water outlet function respectively, the pressing waterway switch device is installed in the shower body with the button disposed outside. Comparing to the existing known technology, the technical solution of the present invention has advantages as follows:

The pressing waterway switch device of present invention not only can perform the function of water outlet or the outlet mode switching function easily and stably, but also designing with said transmission component to make the first transmission structure cooperate to the outer side of the fixed housing therefore generating following advantages: simplified quantities of important components in transmission process in order to reduce structural error and enhance working stability; the transmission structure is partially visible to enhance convenience to control, maintenance, disassembly and assembly; the first transmission structure and second transmission structure are disposed at two ends of rotating shaft respectively to make better balance of the rotating shaft for water sealing. Moreover, the present invention integrally is with less components, as well as with more simple structure and lower cost; only one elastic piece can accomplish the function so that less operation power is needed for pressing the button; the whole structure is contact to work in more stable and reliable status.

The present invention will be further described with following drawings and the embodiments to make the present invention more clear and well-known, the embodiments of the pressing waterway switch device of the present invention is used to describe the present invention but not to limit the scope of the present invention.

DETAILED DESCRIPTION OF THE EMBODIMENTS

Embodiment 1

Figure 1:
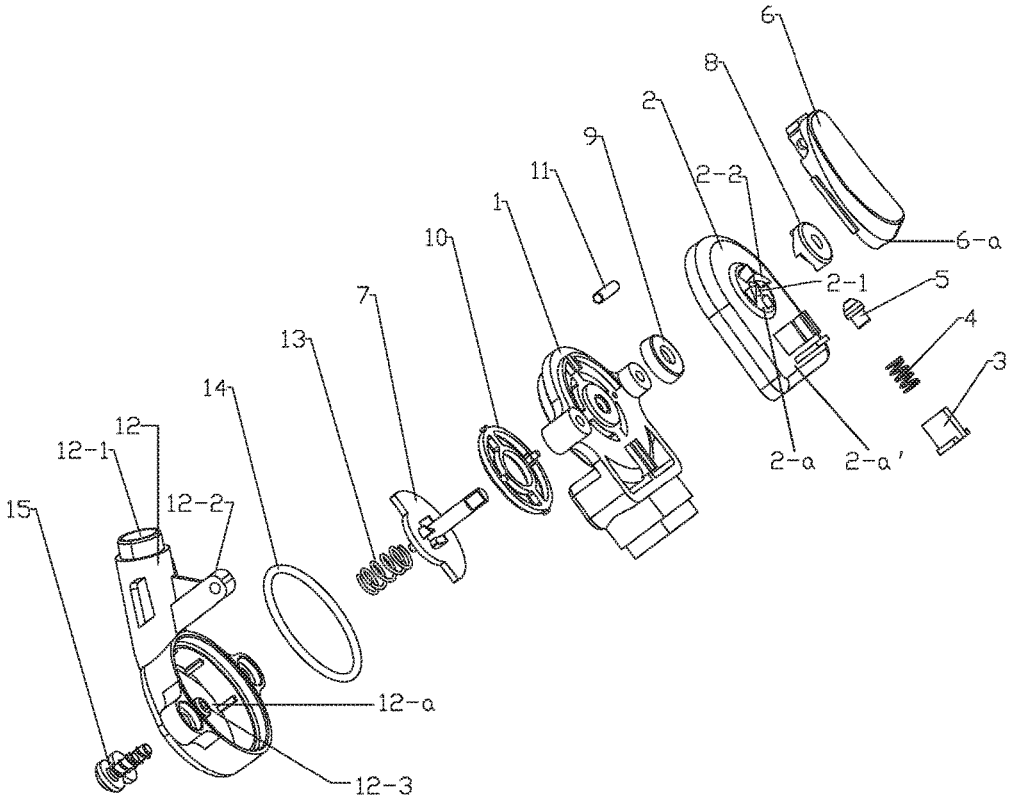
FIG. 1 illustrates an exploded and schematic diagram of the pressing waterway switch device of the present invention.

Please referring to FIGS. 1~12, a pressing waterway switch device of the invention, comprises a fixed housing and a pressing switch mechanism, the fixed housing is disposed with two water outlet channels 1-5,1-6 corresponding to three kinds of water outlet modes. Herein, the water outlet mode is defined to be a kind of combination of the water outlet channel in the state of circulation when water outlet going through the fixed housing, that is specified that: the first kind of water outlet mode is that water outlet from water outlet channels 1-5, the second kind of water outlet mode is that water outlet from another water outlet channels 1-6, the third kind of water outlet mode is that water outlet from both water outlet channels 1-5 and 1-6.

The pressing switch mechanism comprises:

The button 6 is movably connected to the fixed housing;

The switching component 7 is in rotary connection with the fixed housing, the switching component 7 comprises a water diversion plate 71 arranged in the fixed housing as well as a rotating shaft 72 which is coaxially connected with the water diversion plate 71, the rotating shaft 72 stretches out of the inner cavity of the fixed housing from a through hole in a sealing manner; the water diversion plate 71 can rotate with respect to the fixed housing to accomplish outlet function or change water outlet mode in switch manner; In this embodiment, the water diversion plate 71 and the rotating shaft 72 are in integral formation, additionally, it also can take the inserting way to connect the water diversion plate 71 and the rotating shaft 72 in same axial between each other.

The transmission component 8 is in transmission activation with the button 6, transmission component 8 is connected to the rotating shaft 72 while fixed out of the fixed housing, specifically, an oblate hole 8-2 is disposed in the center of transmission component 8, top of the rotating shaft 72 is with an oblate shaft structure 72-1 which can perform motion synchronously with the oblate hole 8-2 after being inserted in; a first transmission structure is arranged between the transmission component 8 and the outer wall of the fixed housing 2-a', when the button 6 pressed, the transmission component 8 and the switching component 7 can perform axial motion and rotate in preset angle under the impact of the first transmission structure; all or part of the button 6, transmission component 8 and the switching component 7 are all or part of connected with an elastic piece which is used for storing energy when the button 6 is pressed;

A second transmission structure is correspondingly arranged between the water diversion plate 71 of the switching component 7 and the inner wall of the fixed housing 1-a', when the button 6 released, said elastic piece will release its energy to urge the transmission component 8 and the switching component 7 to axially return to their original position and maintain rotating in preset angle under the impact of the second transmission structure.

Figure 2:
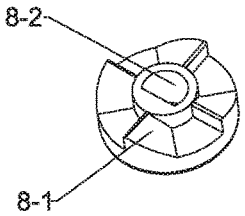
FIG. 2 illustrates a schematic diagram of the transmission component of the present invention.

In this embodiment, as FIG. 1, FIG. 2 shown, said first transmission structure comprises several first ratchets 8-1 which are circumferentially disposed on said transmission component 8 at interval as well as several second ratchets 2-2 disposed on the outer wall of said fixed housing at interval along circumferential direction around said through hole to mesh with the first ratchets 8-1, when said elastic piece releases its energy, the first ratchets 8-1 will detach from the second ratchets 2-2 with staggered position against each other. The above mentioned that the transmission component 8 and the switching component 7 can rotate in preset angle under the impact of the first transmission structure means that: the first ratchets 8-1 will gradually go meshing with the second ratchets 2-2 when the transmission component 8 performs axial motion, then in the result of urging the transmission component 8 and the switching component 7 to rotate in preset angle.

Figure 3:
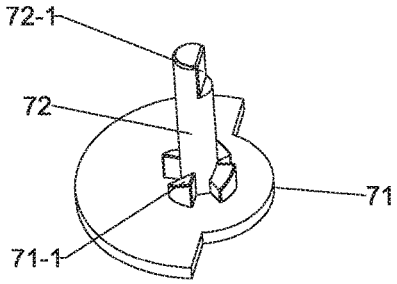
FIG. 3 illustrates a schematic diagram of the switching component of the present invention.
Figure 4:
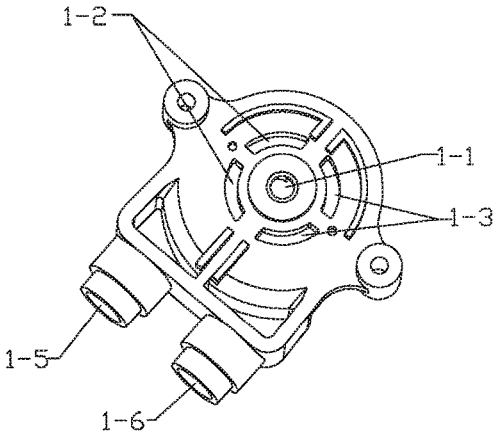
FIG. 4 illustrates a schematic diagram of the lower cover of the present invention from front side.
Figure 5:
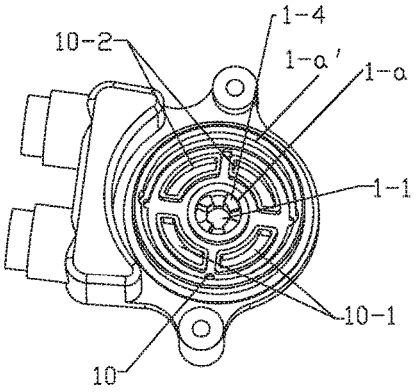
FIG. 5 illustrates a schematic diagram of the lower cover of the present invention from back side.
Figure 6:
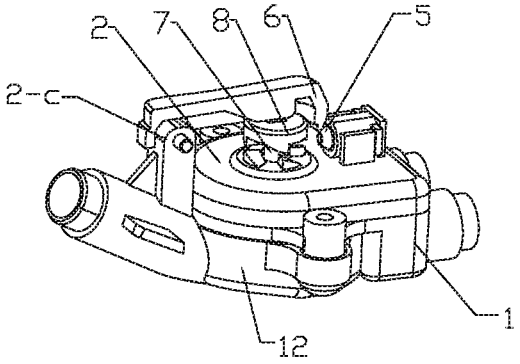
FIG. 6 illustrates a block diagram of the pressing waterway switch device of the present invention.
Figure 7:
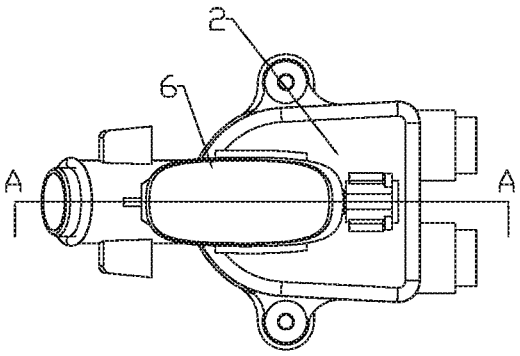
FIG. 7 illustrates a top view of the pressing waterway switch device of the present invention.
Figure 8:
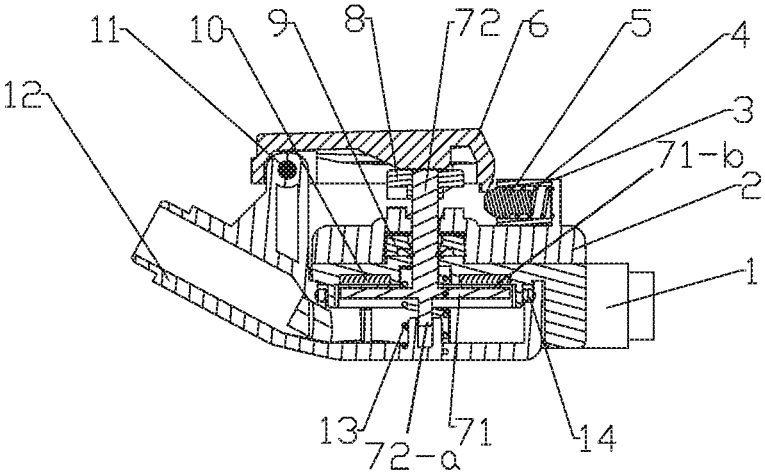
FIG. 8 illustrates an A-A sectional diagram of FIG. 7.

In this embodiment, as FIG. 3, FIG. 5 shown, said second transmission structure comprises several third ratchets 71-1 which are circumferentially disposed on said water diversion plate 71 at interval as well as several fourth ratchets 1-4 disposed on the inner wall of said fixed housing at interval along circumferential direction around said through hole to mesh with the third ratchets 71-1, when said elastic piece stores its energy, the third ratchets will detach from the fourth ratchets with staggered position against each other. The above mentioned that the transmission component 8 and the switching component 7 can axially return to their original position and maintain rotating in preset angle under the impact of the second transmission structure, means that: the third ratchets 71-1 will gradually go meshing with the fourth ratchets 1-4 when switching component 7 axially return to their original position, then in the result of urging the transmission component 8 and the switching component 7 to maintain rotating in preset angle.

In this embodiment, a spring bead is installed on said fixed housing near the side (6-a) of said button 6, when said button 6 is pressed, the spring bead will be pushed and extruded from the side at the same time. The spring bead is specifically including a spring bead support bracket 3, a small spring 4 and a spring bead 5, the spring bead 5 is installed on the support bracket 3 and is capable of making motion axially, the small spring 4 is disposed between the spring bead 5 and the inner side of the support bracket 3 and pushes against each other.

In this embodiment, an inlet cavity with inlet hole 12-1 are arranged in said fixed housing, two groups of first water-through holes 1-2, 1-3 are circumferentially disposed on the fixed housing, each group of first water-through holes comprise more two water-through holes, the two groups of first water-through holes 1-2, 1-3 are connected to the inlet cavity and are corresponding to and communicated with the two water outlet channels 1-5, 1-6 respectively, the water diversion plate 71 can make each group of first water-through holes be functional of water outlet simultaneously or selectively by its rotation with respect to the fixed housing. Herein, the two water-through holes of each group of first water-through holes are arranged beside each other in circumferential direction, so, the four water-through holes are disposed at even interval in circumferential direction. Moreover, it is applicable that the two water-through holes of each group of first water-through holes are arranged in radial direction; The quantity of each group of first water-through holes could be set to one, or more than three (note: "more than #" mentioned in this content means includes the number # itself).

In this embodiment, said fixed housing comprises an upper cover 2, a lower cover 1 and a base 12, the upper cover 2 and the lower cover 1 are fixed with each other (specifically, the upper cover 2 and the lower cover 1 are fixed with each other in the way of ultrasonic wielding), and form said two water outlet channels 1-5, 1-6, the lower cover 1 is disposed with two groups of first water-through holes 1-2, 1-3, the lower cover 1 and the base 12 are fixed with each other (specifically, the lower cover 1 and the base 12 are fixed with each other in the way of screw locking and an O shape ring 14 is cooperated with each other for sealing between the lower cover 1 and the base 12), the lower cover 1 and the base 12 enclose said inlet cavity, the inlet hole 12-1 of said inlet cavity is arranged on the base 12; said water diversion plate 71 is set in the inlet cavity. The upper cover 2 and the lower cover 1 are respectively provided with said through hole 2-1, 1-1 to let said rotating shaft 72 go through, and a V shape sealing ring 9 is coupled on the top of said rotating shaft 72, an annular groove is arranged on lower cover 1 at the position corresponding to inner side of its through hole 2-1, the sealing ring 9 is set in the annular groove to seal the gap between said rotating shaft 72 and said upper cover 2. The invention also comprises a sealing cushion 10, the sealing cushion 10 is provided with two groups of second water-through holes 10-1, 10-2 corresponding to and communicating with each group of said first water-through holes, the sealing cushion 10 is installed at the inner side of the lower cover 1, when said button 6 is released, said water diversion plate 71 would be tightly attached to the sealing cushion 10, the sealing cushion 10 is used to seal the gap (71-b) between said water diversion plate 71 and the lower cover 1. The outer side of the upper cover 2 is disposed with said four second ratchets 2-2 in circumferential direction around its through hole 2-1, the inner side of the lower cover 1 is disposed with said fourth ratchets 1-4 in circumferential direction around its through hole 1-1. The spring bead mentioned above is fixed on the outer side of the upper cover 2 in radial direction along through hole 2-1.

In this embodiment, said water diversion plate 71 is set in cam structure while its rotation with respect to the lower cover 1 can make three kinds of motion: close certain group of the first water-through hole 1-2 of the lower cover 1; close another group of the first water-through hole 1-3 of the lower cover 1; simultaneously close one water-through hole of both first water-through hole 1-2, 1-3 of the lower cover 1. Additionally, the water diversion plate 71 can be designed in the shape of round plate disposed with two dividing holes, therefore, the water diversion plate 71 can make three kinds of motion by its rotation with respect to the lower cover 1: two dividing holes are respectively connected two water-through holes of certain group of the first water-through hole 1-2 of the lower cover 1; two dividing holes are respectively connected two water-through holes of another group of the first water-through hole 1-3 of the lower cover 1; two dividing holes are respectively connected two water-through holes of one water-through hole of both first water-through hole 1-2, 1-3 of the lower cover 1. In this embodiment, a shaft hole 12-3 is disposed at the inner bottom side (12-a) of said base 12, the bottom end (72-a) of said rotating shaft 72 is movably connected to and inserts in the shaft hole 12-3; the quantity of said elastic piece and to be a spring 13, which is disposed between said water diversion plate 71 and the inner bottom side of base 12 and pushes against each other, moreover, the spring 13 can be also disposed between the transmission component 8 and the upper cover 2. Said base 12 is extending upwardly with a support bracket 12-2, one end of said button 6 is pivotally connected to the support bracket 12-2 with a pivot pin 11. Additionally, said button 6 also can be directly movably connected to the upper cover 2 or installed on the shower body mentioned as follow.

The pressing waterway switch device of the invention, the working process of the pressing switch mechanism is that:

Pressing the button 6, then the button 6 would urge transmission component 8 and the switching component 7 to axially do motion downwardly, meanwhile, the button 6 would extrude the spring bead 5 from the side like the feeling of pushing gear;

When the transmission component 8 and the switching component 7 axially do motion downwardly, the spring 13 will be compressed to store energy, meanwhile each first ratchet 8-1 of the transmission component 8 will gradually mesh with each second ratchet 2-2 of the upper cover 2 correspondingly, to make the transmission component 8 and the switching component 7 rotate along the clockwise direction in half gear position's angle (to be 45°), as well as, each third ratchet 71-1 of the water diversion plate 71 will detach from the fourth ratchets 1-4 of the lower cover 1;

Releasing the button 6, then the spring 13 would release energy, to urge the button 6, the transmission component 8 and the switching component 7 to return to original place axially (axially do motion upwardly), on the one hand, each first ratchet 8-1 of the transmission component 8 will detach from each second ratchet 2-2 of the upper cover 2, on the other hand, each third ratchet 71-1 of the water diversion plate 71 will gradually mesh with the fourth ratchets 1-4 of the lower cover 1, to make the transmission component 8 and the switching component 7 keep rotating along the clockwise direction in half gear position's angle (to be 45°).

Combining the above two half gear position's angle together, means that, in the process of pressing the button 6 then releasing, the water diversion plate 71 will rotate in a full gear position's angle (to be 90°) with respect to the lower cover 1, meanwhile make two groups of first water-through holes 1-2, 1-3 of the lower cover 1 be functional of water outlet simultaneously or selectively.

Figure 9:
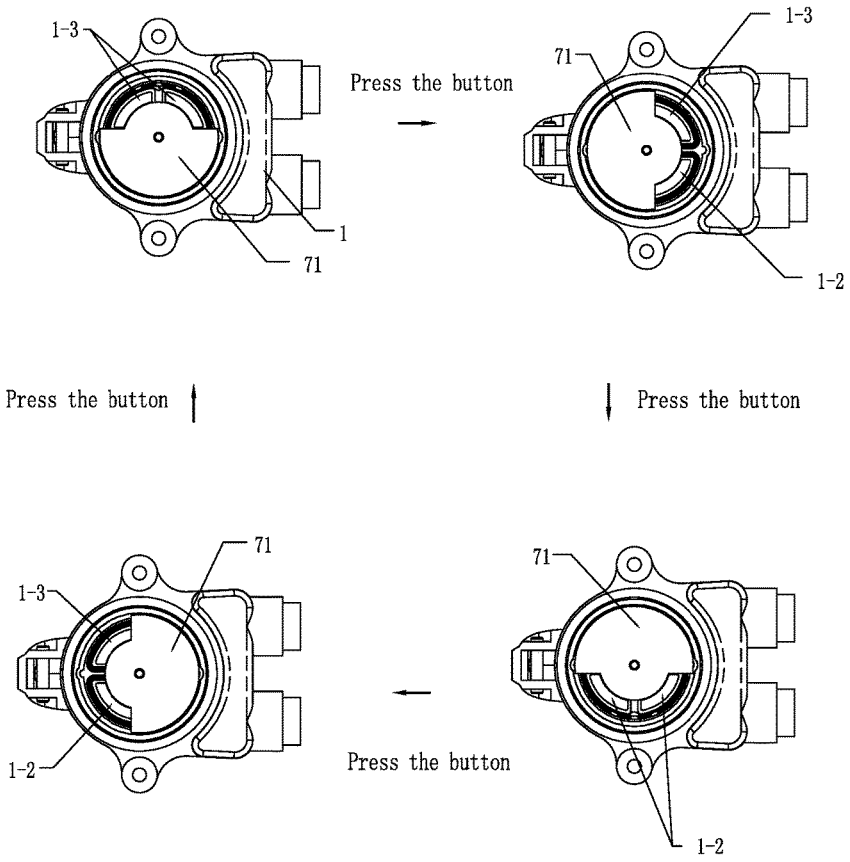
FIG. 9 illustrates a diagram of changeable motion of the pressing waterway switch device of the present invention.
Figure 10:
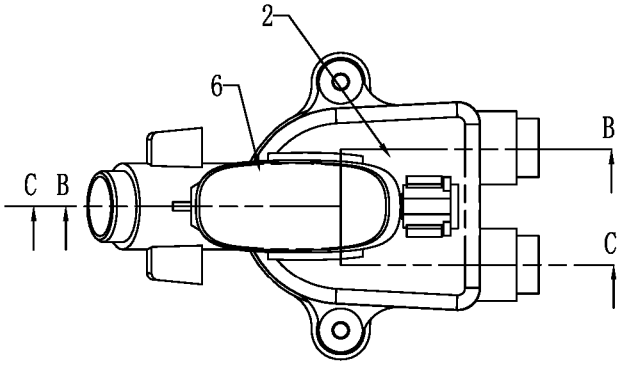
FIG. 10 illustrates a top view of the pressing waterway switch device of the present invention.
Figure 11:
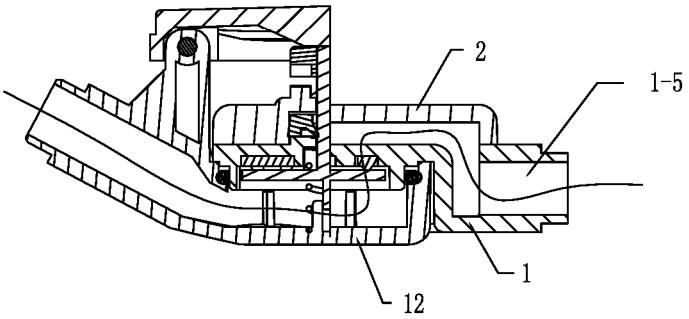
FIG. 11 illustrates a B-B sectional diagram of FIG. 10.
Figure 12:
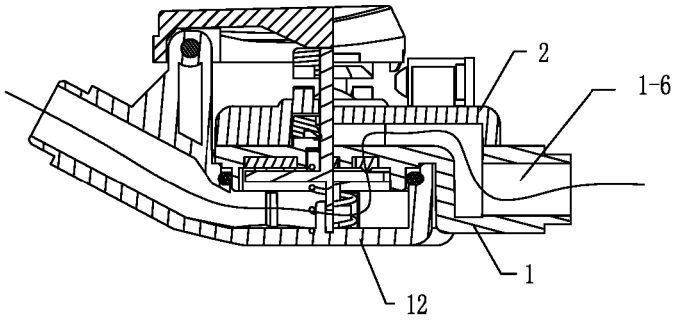
FIG. 12 illustrates a C-C sectional diagram of FIG. 10.

When the water diversion plate 71 rotate with respect to the lower cover 1, it will accomplish four different states of motion, the changing process of four states of motion is shown as FIG. 9, the original state is assumed that: the water diversion plate 71 closes certain group of the first water-through hole 1-2 of the lower cover 1, and opens another group of the first water-through hole 1-3 of the lower cover 1, at this time, the outlet status of another group of the first water-through hole 1-3 of the lower cover 1 and the corresponding water outlet channel 1-6 as shown in FIG. 12; after first time of pressing the button 6 then releasing, the state is changing to that: the water diversion plate 71 closes one water-through hole of both first water-through hole 1-2, 1-3 of the lower cover 1, and opens another water-through hole of both first water-through hole 1-2, 1-3 of the lower cover 1; after second time of pressing the button 6 then releasing, the state is changing to that: the water diversion plate 71 closes another group of first water-through hole 1-3 of the lower cover 1 and opens certain group of the first water-through hole 1-2 of the lower cover 1, at this time, the outlet status of certain group of the first water-through hole 1-2 of the lower cover 1 and the corresponding water outlet channel 1-5 as shown in FIG. 11; after third time of pressing the button 6 then releasing, the water diversion plate 71 closes one water-through hole of both first water-through hole 1-2, 1-3 of the lower cover 1, and opens another water-through hole of both first water-through hole 1-2, 1-3 of the lower cover 1; after fourth time of pressing the button 6 then releasing, the water diversion plate 71 returns to its original state: closes certain group of the first water-through hole 1-2 of the lower cover 1, and opens another group of the first water-through hole 1-3 of the lower cover 1.

Figure 13:
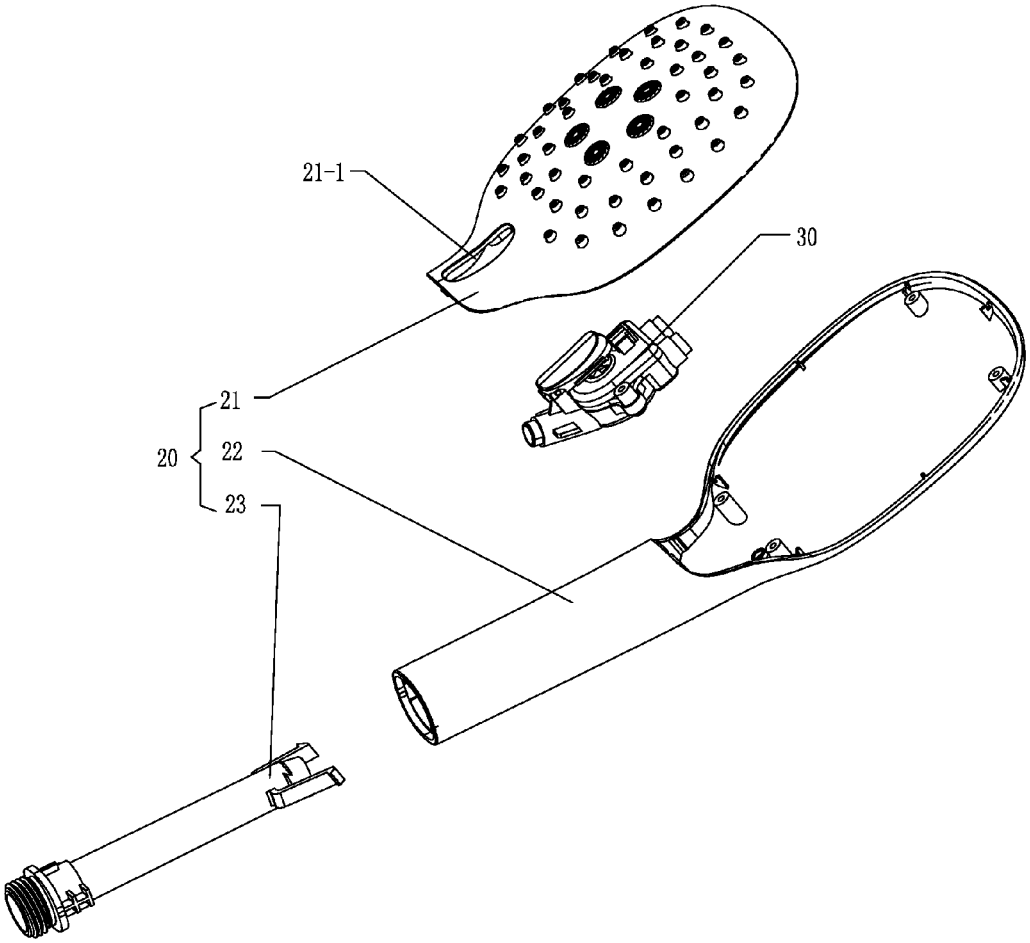
FIG. 13 illustrates an exploded of the shower of the present invention.
Figure 14:
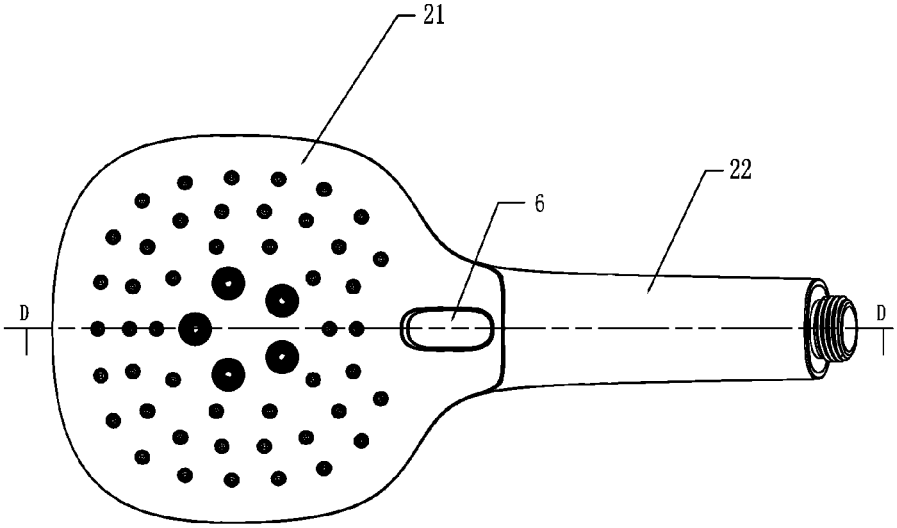
FIG. 14 illustrates a top view of the shower of the present invention.
Figure 15:
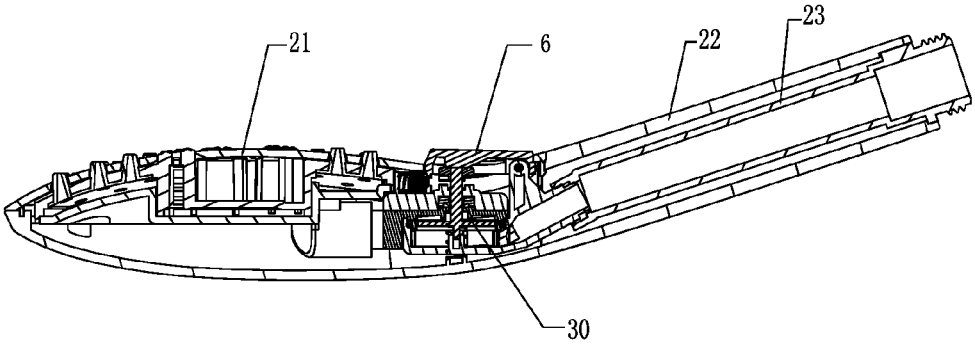
FIG. 15 illustrates a D-D sectional diagram of FIG. 14.

The pressing waterway switch device of the invention, the ratchets mentioned as above can be also called oblique tooth, moreover, said first transmission structure and second transmission structure is not limited to the structure mentioned in this embodiment. Said water outlet channels is not limited in two, said first water through hole is not limited in two groups. Please referring to FIGS. 13~15, a shower of the invention, comprises a shower body 20 and the pressing waterway switch device mentioned as above, said fixed housing is provided with at least two water outlet modes which are corresponding to each water outlet function respectively, the pressing waterway switch device is installed in the shower body with the button disposed outside, shower body 20 is provided with three kinds of water outlet function, which are respectively corresponding to the water outlet modes of the above pressing waterway switch device 30, the pressing waterway switch device 30 is installed in the shower body 20 with the button 6 disposed outside.

Specifically, said shower body comprises a handle and an outer case 22 on the outlet rear cover, inlet tube 23 and cover assembly 21, the cover assembly 21 is designed to be functional for two kinds of water outlet (this embodiment will not describe the structure of the cover assembly 21 in detailed cause it belongs to prior art), in this embodiment, the kind of outlet function is defined to be certain spray mode of water outlet every time from the shower, the two kinds of outlet function is specified that: shower spray function and massage spray function, and the third kind of outlet function is accomplished by shower spray combined with massage spray together, the cover assembly 21 is fixed to the outlet rear cover outer of the outer case 22, the pressing waterway switch device 30 is installed in the cavity enclosed by the cover assembly 21 and the outer case 22, and the two outlet channels 1-5, 1-6 are cooperated with the cover assembly 21 to accomplish two kinds of outlet function (such as shower spray, massage spray) by being corresponding to and communicating with the outlet holes or the outlet cavity. The cover assembly 21 is provided with an accommodation hole 21-1 to accommodate the button 6 to make the button 6 disposed outside the show body 20 for easy operation. The inlet tube 23 is installed in the handle cavity of the outer case 22 and is connected to the inlet hole 12-1 of the pressing waterway switch device 30.

For the shower of the invention, it's convenient and force-saving in operation, because just only pressing the button 6 can make the outlet function changed.

For the shower of the invention, not only can be a hand-held shower, but also can be a kitchen shower, top-spray shower (or called head shower, sunflower shower or so on).

Embodiment 2

For the pressing waterway switch device of the invention, the difference from the embodiment 1 is that: the fixed housing is set to be a showing housing, that means, the pressing waterway switch device is a shower by itself, it can be a hand-held shower, a kitchen shower or a top-spray shower with at least two outlet function (same as or similar with embodiment 1), an insulation board is disposed at inner side with at least two groups of water-through hole arranged along circumferential direction, each group of water-through holes comprises more than one water-through hole, the at least two groups of water-through holes are connected to the inlet cavity of the shower housing and are corresponding to the at least two water outlet function of the shower housing respectively. Meanwhile, said second ratchet can be disposed at the outer side of the shower housing, said fourth ratchet can be disposed on the insulation board for switching outlet function by urging the water diversion plate 71 to rotate with the respect to the insulation board.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A pressing waterway switch device, comprising a fixed housing and a pressing switch mechanism, the fixed housing being capable of discharging water in at least two functions or two modes, wherein the pressing switch mechanism comprises:

a button;

a switching component in rotary connection with the fixed housing, comprising a water diversion plate arranged in the fixed housing and a rotating shaft which is coaxially connected with the water diversion plate and stretches out of the fixed housing from a through hole in a sealing manner, the water diversion plate rotating with respect to the fixed housing for accomplishing a certain water outlet function or switching water outlet mode;

a transmission component configured to be activated by the button and being connected to the rotating shaft, and a first transmission structure being arranged between the transmission component and an outer wall of the fixed housing, the transmission component and the switching component, in response to the button being pressed, performing axial motion and rotating in a preset angle under an impact of the first transmission structure;

the button, the transmission component and the switching component being coupled with an elastic piece which is used for storing energy in response to the button being pressed; and a second transmission structure being correspondingly arranged between the water diversion plate of the switching component and an inner wall of the fixed housing, wherein said first transmission structure comprises a plurality of first ratchets which are circumferentially disposed on said transmission component at intervals, as well as a plurality of second ratchets disposed on the outer wall of said fixed housing at intervals along a circumferential direction around said through hole to mesh with the first ratchets, in response to the button being released, said elastic piece releases the stored energy to urge the transmission component and the switching component to axially return to an original position and maintain rotating in the preset angle under an impact of the second transmission structure, the first ratchets, in response to the elastic piece releasing the stored energy, detach from the second ratchets with staggered positions against each other, and the elastic piece abuts against a lower surface of the water diversion plate.

2. The pressing waterway switch device according to claim 1, wherein said second transmission structure comprises a plurality of third ratchets which are circumferentially disposed on said water diversion plate at intervals, as well as a plurality of fourth ratchets disposed on the inner wall of said fixed housing at intervals along a circumferential direction around said through hole to mesh with the third ratchets, the third ratchets, in response to the elastic piece releasing the stored energy, detaching from the fourth ratchets with staggered positions against each other.

3. The pressing waterway switch device according to claim 2, wherein said fixed housing is set to be a shower housing with at least two water outlet functions and disposed with at least two groups of water-through holes in a circumferential direction, each group of water-through holes comprises a plurality of water-through holes, the at least two groups of water-through holes are connected to an inlet cavity of the shower housing and correspond to the at least two water outlet functions of the shower housing respectively, and said water diversion plate is configured to make each group of water-through holes function as water outlets simultaneously or selectively by rotation with respect to the shower housing.

4. A shower, comprising: a shower body which is provided with at least two water outlet functions, and said pressing waterway switch device according to claim 2, wherein said fixed housing is provided with at least two water outlet modes which correspond to each water outlet function respectively, and the pressing waterway switch device is installed in the shower body with the button disposed outside.

5. The pressing waterway switch device according to claim 1, wherein said button is movably connected to an outer side of said fixed housing, a spring bead is installed on said fixed housing near a side of said button, and the spring bead, in response to the button being pressed, is pushed by the side of said button.

6. The pressing waterway switch device according to claim 5, wherein said fixed housing is set to be a shower housing with at least two water outlet functions and disposed with at least two groups of water-through holes in a circumferential direction, each group of water-through holes comprises a plurality of water-through holes, the at least two groups of water-through holes are connected to an inlet cavity of the shower housing and correspond to the at least two water outlet functions of the shower housing respectively, and said water diversion plate is configured to make each group of water-through holes function as water outlets simultaneously or selectively by rotation with respect to the shower housing.

7. The pressing waterway switch device according to claim 1, wherein a quantity of said elastic piece is set to one and said elastic piece is set to be a spring which is disposed between and pushes against said water diversion plate and said fixed housing.

8. The pressing waterway switch device according to claim 7, wherein said fixed housing is set to be a shower housing with at least two water outlet functions and disposed with at least two groups of water-through holes in a circumferential direction, each group of water-through holes comprises a plurality of water-through holes, the at least two groups of water-through holes are connected to an inlet cavity of the shower housing and correspond to the at least two water outlet functions of the shower housing respectively, and said water diversion plate is configured to make each group of water-through holes function as water outlets simultaneously or selectively by rotation with respect to the shower housing.

9. The pressing waterway switch device according to claim 1, wherein at least two water outlet channels and an inlet cavity with an inlet hole are arranged in said fixed housing to accomplish said water outlet modes, and at least two groups of first water-through holes are circumferentially disposed on the fixed housing, each group of first water-through holes comprising a plurality of water-through holes, the at least two groups of first water-through holes are connected to the inlet cavity and correspond to and communicated with the at least two water outlet channels respectively, and said water diversion plate is configured to make each group of first water-through holes function as water outlets simultaneously or selectively by rotation of the water diversion plate with respect to the fixed housing.

10. The pressing waterway switch device according to claim 9, wherein said fixed housing further comprises a base, a lower cover and an upper cover, the lower cover and the base are fixed with each other to enclose said inlet cavity; said water diversion plate is set in the inlet cavity and cooperates with an inner wall of the lower cover to form said second transmission structure, the water diversion plate can rotate with respect to the lower cover; said upper cover and lower cover are respectively provided with said through hole, and said transmission component cooperates with an outer wall of the upper cover to form said first transmission structure.

11. The pressing waterway switch device according to claim 10, wherein said water diversion plate is set in a cam structure, and configured to, while rotating, make each group of first water-through holes function as water outlets simultaneously or selectively.

12. The pressing waterway switch device according to claim 10, wherein a shaft hole is disposed at an inner bottom side of said base, a bottom end of said rotating shaft is movably connected to and inserts into the shaft hole; and a sealing ring is coupled to said rotating shaft to seal a gap between said rotating shaft and said upper cover.

13. The pressing waterway switch device according to claim 10, wherein said base extends upwardly with a support bracket, and one end of said button is pivotally connected to the support bracket with a pivot pin.

14. The pressing waterway switch device according to claim 9, wherein said water diversion plate is set in a cam structure, and configured to, while rotating, make each group of first water-through holes function as water outlets simultaneously or selectively.

15. The pressing waterway switch device according to claim 9, further comprising: a sealing cushion which is provided with at least two groups of second water-through holes corresponding to and communicating with each group of said first water-through holes, said sealing cushion being installed at an inner side of a lower cover of the fixed housing, said water diversion plate, in response to release of said button, attaching to the sealing cushion.

16. The pressing waterway switch device according to claim 1, wherein said fixed housing is set to be a shower housing with at least two water outlet functions and disposed with at least two groups of water-through holes in a circumferential direction, each group of water-through holes comprises a plurality of water-through holes, the at least two groups of water-through holes are connected to an inlet cavity of the shower housing and correspond to the at least two water outlet functions of the shower housing respectively, and said water diversion plate is configured to make each group of water-through holes function as water outlets simultaneously or selectively by rotation with respect to the shower housing.

17. A shower, comprising: a shower body which is provided with at least two water outlet functions, and said pressing waterway switch device according to claim 1, wherein said fixed housing is provided with at least two water outlet modes which correspond to each water outlet function respectively, and the pressing waterway switch device is installed in the shower body with the button disposed outside.

* * * * *